US010589881B2

(12) United States Patent
Vollenkemper et al.

(10) Patent No.: US 10,589,881 B2
(45) Date of Patent: Mar. 17, 2020

(54) DEVICE AND METHOD FOR PACKAGING FLOWABLE MATERIALS

(71) Applicant: HAVER & BOECKER OHG, Oelde (DE)

(72) Inventors: Willi Vollenkemper, Oelde (DE); Christian Westarp, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 329 days.

(21) Appl. No.: 15/508,947

(22) PCT Filed: Sep. 24, 2015

(86) PCT No.: PCT/EP2015/071965

§ 371 (c)(1),
(2) Date: Mar. 6, 2017

(87) PCT Pub. No.: WO2016/046312

PCT Pub. Date: Mar. 31, 2016

(65) Prior Publication Data

US 2017/0291727 A1 Oct. 12, 2017

(30) Foreign Application Priority Data

Sep. 24, 2014 (DE) ..... 10 2014 113 864

(51) Int. Cl.
*B65B 1/46* (2006.01)
*B65B 43/50* (2006.01)
(Continued)

(52) U.S. Cl.
CPC ..... *B65B 1/46* (2013.01); *B65B 1/32* (2013.01); *B65B 43/50* (2013.01); *B65B 43/60* (2013.01); *B65B 63/02* (2013.01)

(58) Field of Classification Search
CPC .. B65B 1/46; B65B 1/32; B65B 43/50; B65B 43/60; B65B 63/02
(Continued)

(56) References Cited

U.S. PATENT DOCUMENTS 279,854 A * 6/1883 Belt ..... B30B 9/3064 100/56
417,609 A * 12/1889 Tuck ..... B65B 1/32 177/54

(Continued)

FOREIGN PATENT DOCUMENTS

CN 1234004 A 11/1999
CN 102923329 A 2/2013

(Continued)

*Primary Examiner* — Mary E McManmon
*Assistant Examiner* — James R Hakomaki
(74) *Attorney, Agent, or Firm* — Pearne & Gordon LLP

(57) ABSTRACT

Apparatus and method for filling flowable materials such as fluids and bulk goods into flexible open-mouth bags, the apparatus including a stationary part and a movable part wherein the movable part is provided with multiple filling stations. Each filling station has a retaining device fastened to the movable part. A plurality of handling stations are received and distributed at the stationary part. A handling station is configured to take over empty open-mouth bags and a handling station is configured for filling a bag. One handling station is provided with a weighing unit. A bag receiving unit is configured to receive and guide the bag. The bag receiving unit at the handling station equipped with a weighing unit can be temporarily decoupled from force transmission to the retaining device to enable separate weighing of the bag receiving unit with the bag.

20 Claims, 4 Drawing Sheets

Figure 1:
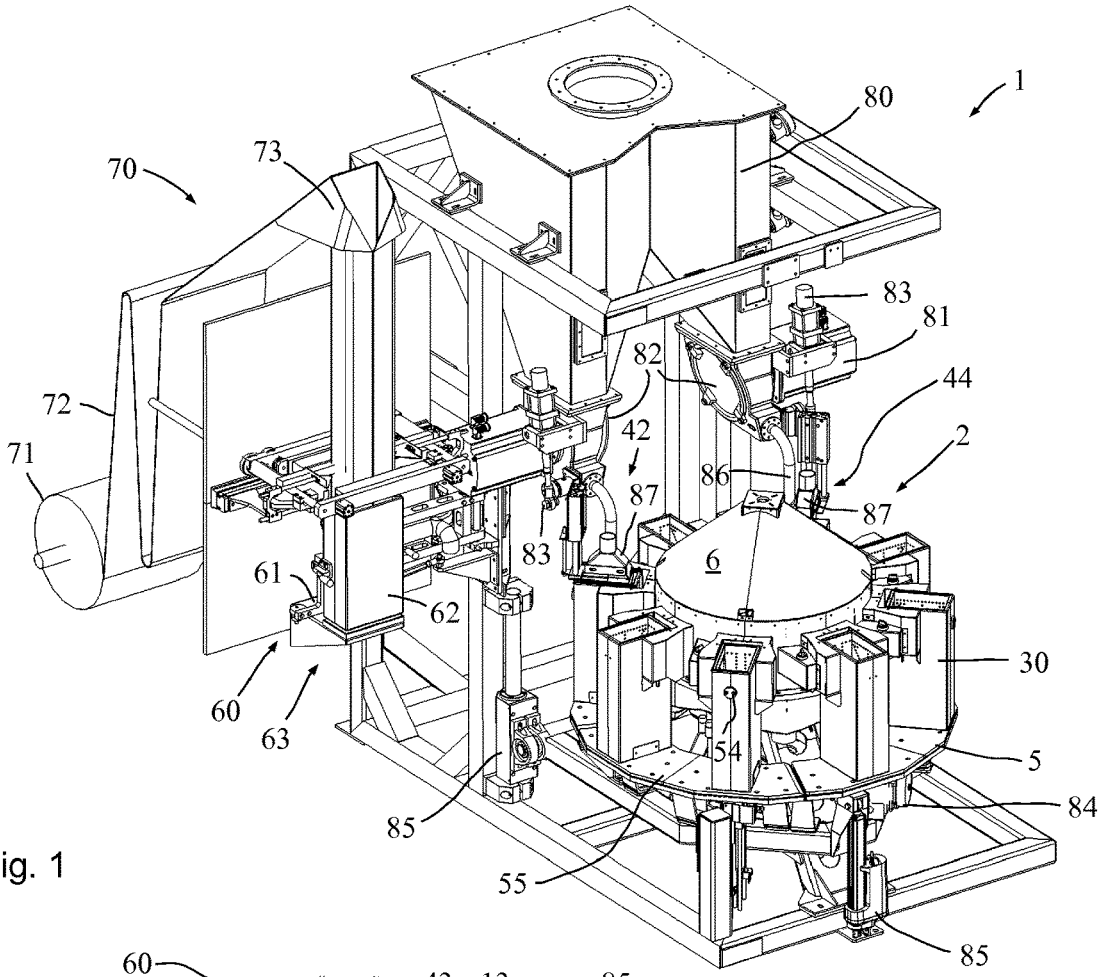

(51) Int. Cl.
*B65B 43/60* (2006.01)
*B65B 1/32* (2006.01)
*B65B 63/02* (2006.01)

(58) Field of Classification Search
USPC ..... 141/83, 80, 166, 265, 315, 316; 53/58, 53/284.5
See application file for complete search history.

(56) References Cited

U.S. PATENT DOCUMENTS 588,168 A * 8/1897 Nickerson ..... B65B 5/101 53/58
667,560 A * 2/1901 Nickerson ..... B65B 1/32 177/55
819,930 A * 5/1906 Sawyer ..... B65B 1/32 177/54
2,281,516 A * 4/1942 Royal ..... B65B 43/30 53/386.1
2,831,510 A * 4/1958 Carter ..... B65B 1/16 141/59
3,073,400 A 1/1963 Bauder et al.
3,112,777 A * 12/1963 Lohse ..... B65B 43/60 141/166
3,785,410 A * 1/1974 Carter ..... B65B 31/044 141/10
3,866,474 A * 2/1975 Hasselmann ..... G01N 1/24 73/864.34
4,074,507 A 2/1978 Ruf et al.
4,137,689 A 2/1979 McClusky et al.
4,300,600 A 11/1981 Tetenborg et al.
5,005,341 A * 4/1991 Tetenborg ..... B65B 43/30 141/114
5,199,246 A * 4/1993 Rodrigo ..... B29C 63/0043 156/273.1
6,321,513 B1 11/2001 Meixner
6,800,818 B2 * 10/2004 Balboni ..... B65B 3/003 141/83
8,453,686 B2 * 6/2013 Klaus ..... B65B 3/16 141/139
9,540,123 B2 1/2017 Vollenkemper
2014/0305542 A1 10/2014 Vollenkemper

FOREIGN PATENT DOCUMENTS

CN 203612231 U 5/2014
CN 104039653 A 9/2014
DE 1275785 B 8/1968
DE 2715309 A1 7/1978
DE 2850668 A1 5/1980
DE 4428610 A1 2/1996
DE 102008020254 A1 10/2009
DE 102011119451 A1 5/2013
JP H07329931 A 12/1995

* cited by examiner

DEVICE AND METHOD FOR PACKAGING FLOWABLE MATERIALS

The present invention relates to an apparatus and a method for bagging flowable materials such as fluids and bulk goods into empty open-mouth bags. The packaging machine shows a stationary part with multiple handling stations and a movable part with multiple filling stations traveling along.

Bulk goods are in particular filled into flexible, empty open bags, so-called open-mouth bags, by way of the invention. The invention is in particular suitable for bagging bulk goods such as cement, high-quality tile grout, other construction materials or the like, into open-mouth bags, wherein different bag sizes may optionally be processed so as to bag filled weights between approximately 1 kg and 10 kg. Higher and lower filled weights are also conceivable. These open-mouth bags may also be called pouch or small sack.

A number of apparatuses have been disclosed in the prior art for filling flowable materials into open-mouth bags. Filling the open-mouth bags tends to provide for gripping the bags at their open tops and retaining same during filling to ensure defined handling of the bags. This allows to decrease consumption of plastic sheets since the bags consisting of tubular sheets or manufactured from flat sheets do not need to be made any longer than is required for the filling job. The drawback of these processes is a comparatively complex equipment for retaining and guiding the open-mouth bags and for filling. When bagging filled weights of only 1 kg or 5 kg or 10 kg, then the relative operating expenses increase still more due to the low filled weight.

Unlike when bagging bulk goods or liquids into open-mouth bags or sacks, filling these materials into containers having firm sidewalls does not require the same amount of work since open-top containers having firm sidewalls can always assume a precisely defined location and position. This is why open-top containers such as buckets or cartons or e.g. prefabricated, stiff paper bags having firm sidewalls can be positioned on conveyor belts or the like and thus conveyed to the filling stations where the intended material is filled in from above. This is not as simple for filling flowable materials into flexible open-mouth bags since due to the flexible, plastic bag material there is no defined filling mouth available or ensured with transport on a conveyor belt.

It is therefore the object of the present invention to provide an apparatus and a method enabling reliable filling of open-mouth bags while keeping the overhead down.

This object is solved by an apparatus having the features of claim 1 and by a method having the features of claim 17. Preferred specific embodiments of the invention are the subjects of the subclaims. Further advantages and features of the present invention can be taken from the general description and the description of the exemplary embodiment.

An apparatus according to the invention serves to fill flowable materials such as fluids and bulk goods into empty open-mouth bags. The apparatus comprises a stationary part and a movable part. The movable part is provided with multiple filling stations traveling along. Each of the filling stations is provided with a retaining device fastened to the movable part. The stationary part is provided with multiple distributed handling stations. At least one handling station is configured as a takeover station for taking over empty open-mouth bags. At least one handling station serves to at least partially fill an open-mouth bag and at least one in particular different handling station is provided with a weighing unit. A bag receiving unit to receive a bag is attached to each of the retaining devices. The bag receiving unit is configured to receive and guide the bag. The bag receiving unit at the handling station equipped with a weighing unit can be at least temporarily decoupled from force transmission to the retaining device to enable separate weighing of the bag receiving unit with the open-mouth bag.

The apparatus according to the invention has many advantages. A considerable advantage of the apparatus according to the invention ensues in that an as yet empty open-mouth bag intended for filling is received at a bag receiving unit at the takeover station. Thereafter the bag receiving unit is taken to the other handling stations by means of the movable part where the open-mouth bag is filled. To enable a precise filled weight, the bag receiving unit can be decoupled from the retaining device at the handling station equipped with a weighing unit so as to allow precise weighing of the bag receiving unit with the bag and the bagged material therein.

In preferred embodiments the apparatus comprises a filling carousel acting as the movable part where the different handling stations are distributed over the circumference and disposed preferably stationary. The different handling stations may on the whole be attached to a stationary part such as a base frame or the like or they may each be separately fastened to the floor. In particular the filling carousel is configured rotatably. The filling carousel preferably rotates in increments or indexed in operation. The apparatus is particularly preferably suitable and set up to fill bulk goods into empty open-mouth bags.

A bag receiving unit is in particular configured as a receiving box. The bag receiving unit receives an open-mouth bag intended for filling and guides the open-mouth bag during movement of the movable part. Preferably, after weighing the bag receiving unit at the handling station that is equipped with a weighing unit the bag receiving unit is once again coupled with the retaining device prior to moving the retaining device further. The weighing unit comprises at least one weighing cell.

The retaining device may be a rotating arm attached to a filling carousel and it may represent a fastener for fastening a bag receiving unit.

Preferably a plurality of different handling stations is provided. Other than a takeover station for taking over an open-mouth bag intended for filling at least one handling station is preferably provided for filling in high speed flow and at least one handling station, for filling in low speed flow. Particularly preferably further handling stations are used for compacting. It is possible and preferred for the handling station for low speed flow filling to simultaneously also serve as a weighing station. Then the weighing unit can determine the weight during low speed flow filling so as to enable precise filled weights. Between the handling station for high speed flow filling and the handling station for low speed flow filling at least one compacting station is preferably provided for deaerating and compacting filled bulk goods whose air-enriched volume would otherwise be too large for filling the container entirely in one step.

In all the configurations it is preferred for the receiving box or the bag receiving unit to be tubular in configuration and comprising at least one open top end. The open top end enables feeding an open-mouth bag intended for filling to the bag receiving unit.

In all the configurations it is preferred for a base platform to be disposed at the stationary part beneath the bag receiving unit. Particularly preferably the base platform extends beneath at least a substantial part of the path of motion of the bag receiving unit.

Preferably the bag receiving unit is exchangeable and/or the base platform is height-adjustable. Thus for example bag receiving units showing different heights may be provided at the movable part to enable bagging different filled weights. The base platform is adjusted in height correspondingly.

Particularly preferably the bag receiving unit is configured with an open bottom such that the base platform can support at least part of the open-mouth bag. This configuration is very advantageous since the bag receiving unit serves to retain and guide a received open-mouth bag while the base platform provided beneath the bag receiving unit receives and dissipates the major portion of the weight of the open-mouth bag. The bag receiving unit allows to ensure a defined and reproducible guidance of the open-mouth bags so as to considerably facilitate handling in particular when filling small quantities.

In preferred configurations a bottom plate can be inserted in the open-bottom bag receiving unit which is supported on the base platform at least at the handover station. When the movable part moves the bottom plate is subjected to a relative motion relative to the base platform. In these configurations the bottom plate may be configured as a gliding plate or a wear plate. During filling and during the relative motion of the movable part the open-top bag is supported on the base platform through the bottom plate. This prevents relative motion of the bag bottom relative to the base platform which might cause contamination, scratching, or damage to the bag bottom. Using a bottom plate, which for example glides or rolls across the base platform of the stationary part, will reliably prevent such damage or optical impairment of the open-mouth bags intended for filling.

Preferably at least one locking unit is provided by means of which the bag receiving unit can be transferred from a locking position coupled with the retaining device to a no-force position or decoupling position. The at least one locking unit is preferably provided at, and in particular fastened to, the retaining device. Particularly preferably each retaining device comprises at least one locking device to allow controlled coupling and decoupling of the pertaining bag receiving unit to and from each of the retaining devices.

When transferring a bag receiving unit from the coupled locking position to a decoupling position the bag receiving unit is preferably lowered far enough for the bag receiving unit to be deposited on the base platform or weigh platform located beneath.

The weigh platform has the weighing unit assigned to it so that the weighing unit can capture the weight of the weigh platform including a bag receiving unit deposited thereon.

Preferably the locking unit comprises a height-adjustable clamping cone which is provided to interact with a retaining link plate at the bag receiving unit. The retaining link plate may for example comprise a locking aperture for the clamping cone to engage in. The cone shape of the clamping cone causes automatic centering in the transfer to the locking position.

Preferably the bag receiving unit is lifted in the locking position and the bag receiving unit can be lowered to the no-force decoupling position on a weigh platform. The weigh platform is preferably mechanically separated from the base platform. Preferably the top edge of the weigh platform is on the same level as the top edge of the base platform. Particularly preferably a narrow gap between the weigh platform and the base platform is provided across which the bottom plate glides during the relative motion. The dimensions of the weigh platform are designed such that an entire bag receiving unit can be placed thereon. The weigh platform preferably has a surface that is smaller than double the bottom surface and in particular smaller than the bottom surface of a bag receiving unit times 1.5.

In preferred configurations at least one bag receiving unit and in particular each bag receiving unit is equipped with a recognition unit comprising a unique ID sign. Particularly preferably electronic ID-units are employed such as RFID. These techniques allow a sensor at the stationary part definite identification of the respective bag receiving units. In a first test run or reference run without filling, one complete revolution allows to determine the tare weight of the entire bag receiving units on average or individually so as to enable still more precise filled weights. Any weight changes to the tare weight also allow to capture contamination or other weight affecting changes to the bag receiving unit and a warning signal can optionally be emitted.

At any rate a recognition unit at the bag receiving unit allows to identify the type and thus the shape and size of the bag receiving unit concerned. This allows a control device to definitely deduce whether or not suitable bag receiving units are attached for filling the intended product and the provided quantity. If inadmissible combinations are recognized the further processing may be stopped or a warning signal may be emitted. Such recognition likewise allows to automatically displace the apparatus to a suitable position.

In preferred configurations a filling pipe is assigned to the handling station which is equipped with the weighing unit. The filling pipe at the handling station equipped with the weighing unit serves in particular for low speed flow filling. This handling station can be designated in its entirety as a weighing station or else as a low speed flow filling station.

In preferred specific embodiments at least one further handling station is provided also with a filling pipe assigned thereto. Such a handling station does not comprise a weighing unit as a rule. This handling station is in particular provided for high speed flow filling. For example a time-controlled filling may take place in high speed flow where during a fixedly predetermined and changeable period of e.g. 1 second, 1.5 seconds, 2 seconds, 3 seconds or the like the material intended for filling is supplied through the filling pipe. Furthermore the weighing station then determines the product filled thus far in high speed flow so that the weighing station can then carry out low speed flow filling up to the intended end weight. In dependence on the determined end weight in the high speed flow filling the time period for subsequent high speed flow fillings may be reduced or increased accordingly to thus balance out variations of the filled product.

In all the configurations it is particularly preferred to configure at least one of the handling stations as a compacting station. Using multiple compacting stations is possible and preferred. In particular at least one compacting station is used between the handling station for high speed flow filling and the handling station for low speed flow filling. Compacting the filled bulk goods after high speed flow filling achieves a reduction of the material level. This allows to reduce the bag volume required for filling a specific quantity so as to save costs on the bag material.

In all the configurations it is preferred for the bag receiving unit to include a plurality of suction apertures so that the bag wall lies snug against the receiving space. A bag wall resting snug against the receiving space of the bag receiving unit allows to ensure a reliable, reproducible bag shape and filling mouth of the open-mouth bag. This avoids errors and enhances reproducibility.

The suction apertures generate a vacuum in the receiving space when receiving an open-mouth bag intended for filling so as to cause the open-mouth bag to be sucked into the bag receiving unit and the bag wall to rest form-fittingly against the receiving space. Suction may be maintained during handling at each of the handling stations. It is possible and preferred to stop or reduce suction at the weighing station as the bag receiving unit is transferred to the decoupling position.

In all the configurations it is preferred for the movable part to be moved indexed.

The method according to the invention serves to fill flowable materials such as fluids and bulk goods into empty open-mouth bags. Bagging takes place by means of an apparatus having a stationary part and a movable part wherein the movable part is provided with multiple filling stations traveling along and wherein each of the filling stations is provided with a retaining device fastened to the movable part. The stationary part is provided with multiple distributed handling stations wherein at least one handling station is a takeover station successively taking over empty open-mouth bags and wherein at least one handling station fills the bags at least partially. At least one other handling station is provided with a weighing unit. A bag receiving unit to receive a bag is attached to each of the retaining devices. The bag receiving unit receives the open-mouth bag at the takeover station and guides the bag. The bag receiving units are successively conveyed to the handling stations by means of the movable part. The handling station equipped with a weighing unit provides for temporarily force-decoupling the respective bag receiving unit from the retaining device provided in this place to carry out separate weighing of the bag receiving unit with the open-mouth bag.

The method according to the invention also has many advantages since it allows to simply and efficiently fill flowable materials and in particular bulk goods into empty open-mouth bags.

Further advantages and features of the present invention can be taken from the exemplary embodiment which will be described below with reference to the enclosed figures.

Figure 2:
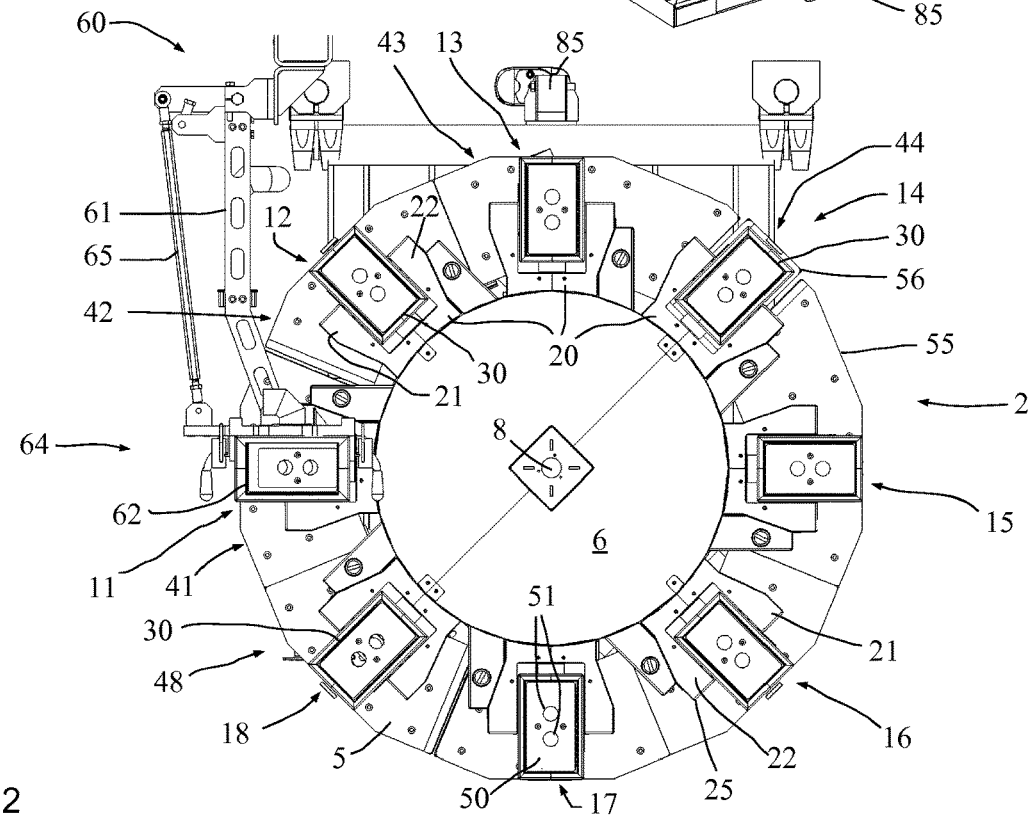
Figure 3:
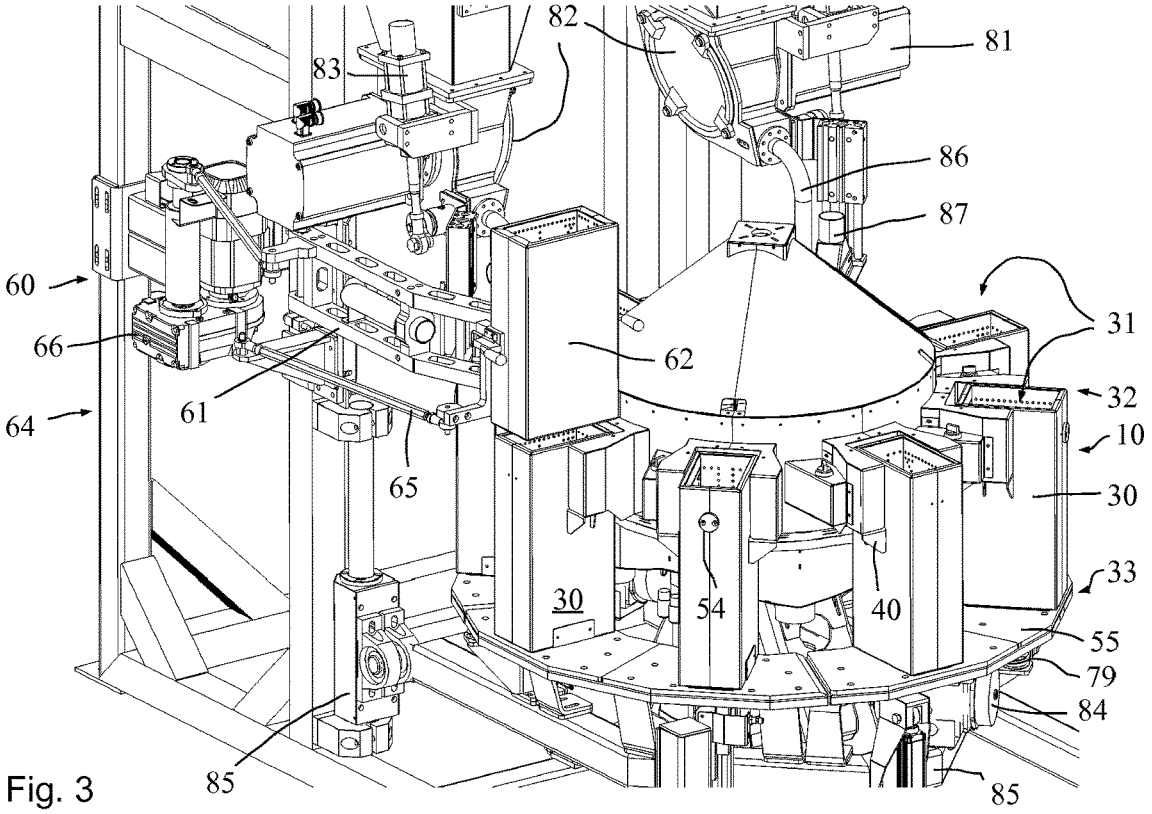
Figure 4:
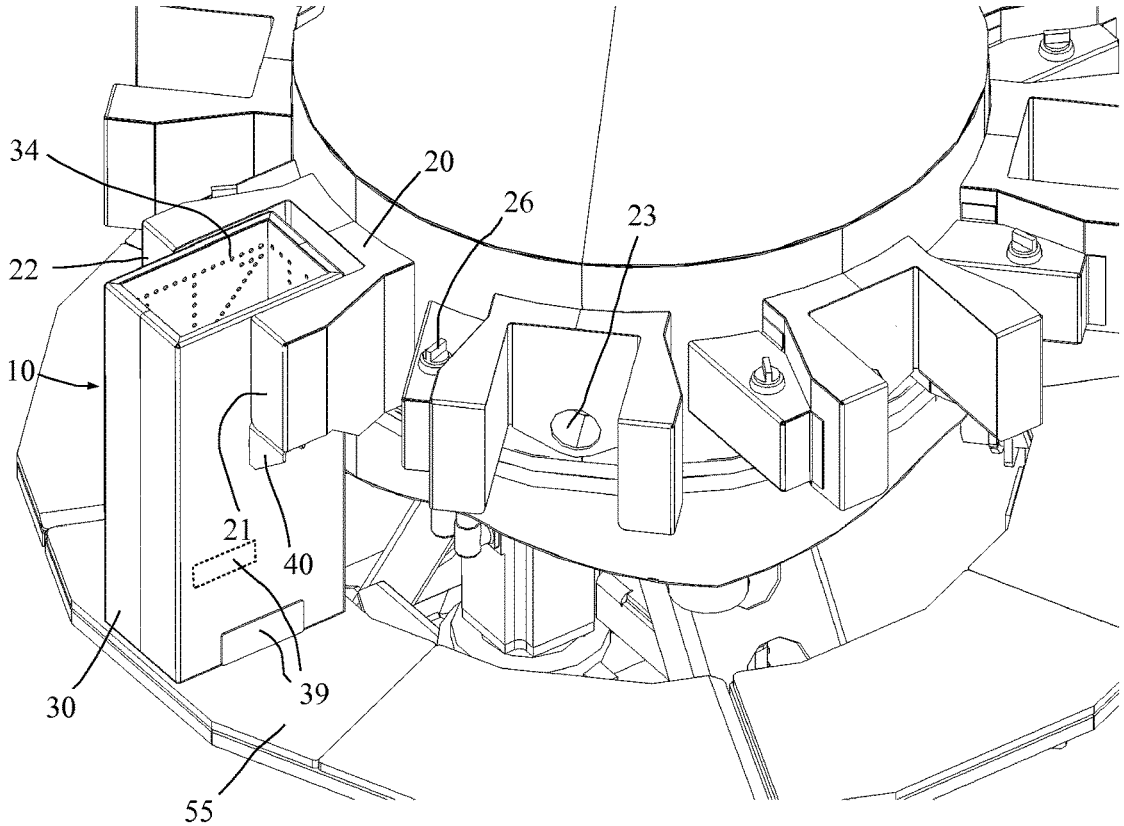
Figure 5:
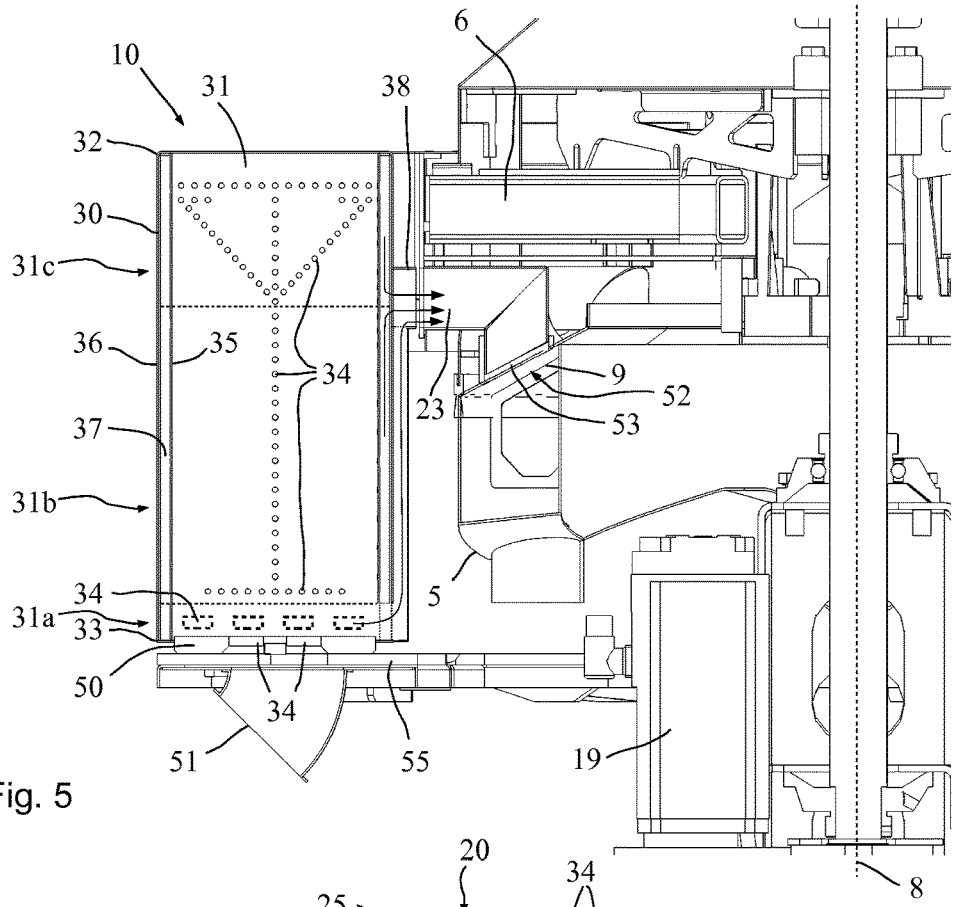
Figure 6:
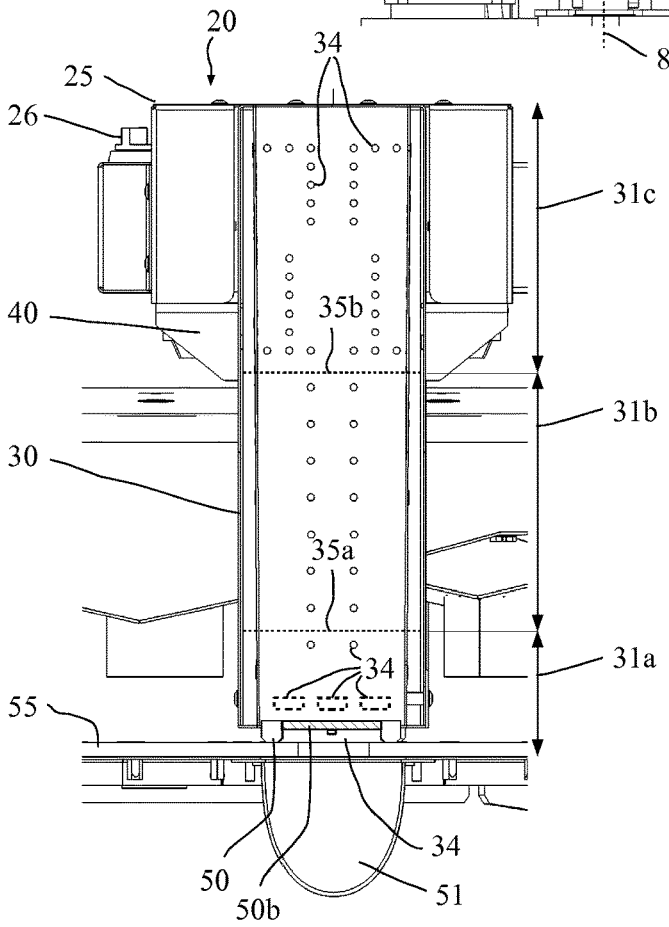
Figure 7:
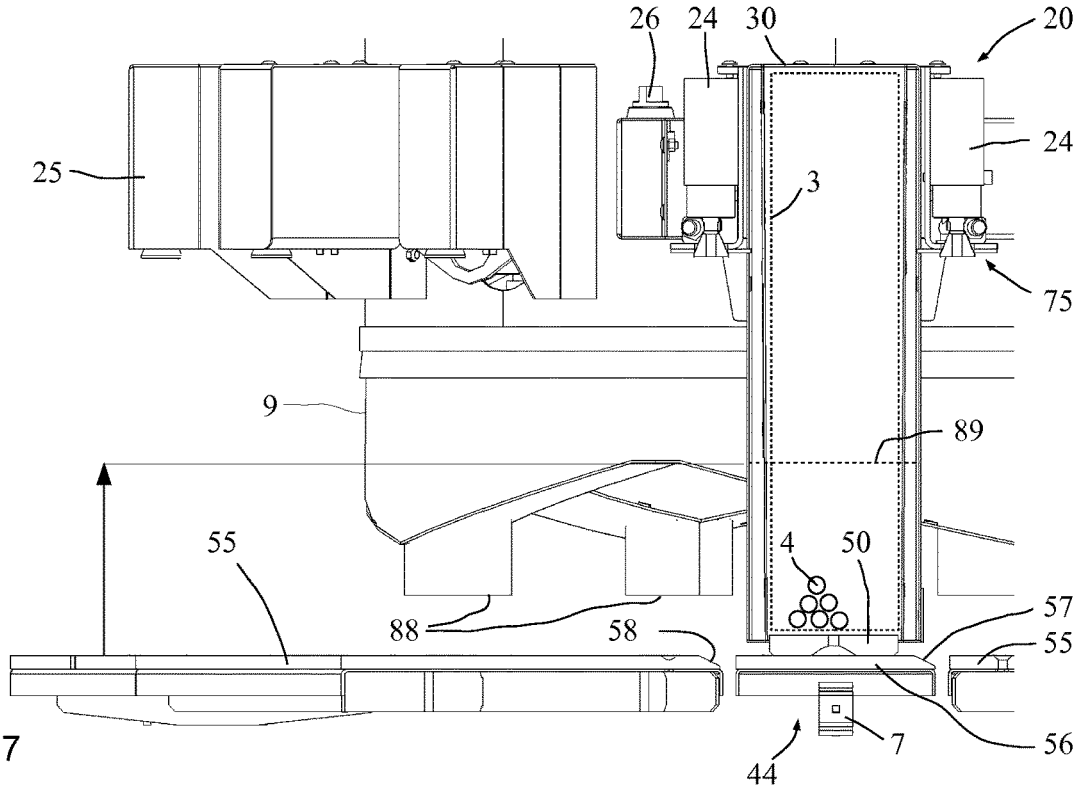
Figure 8:
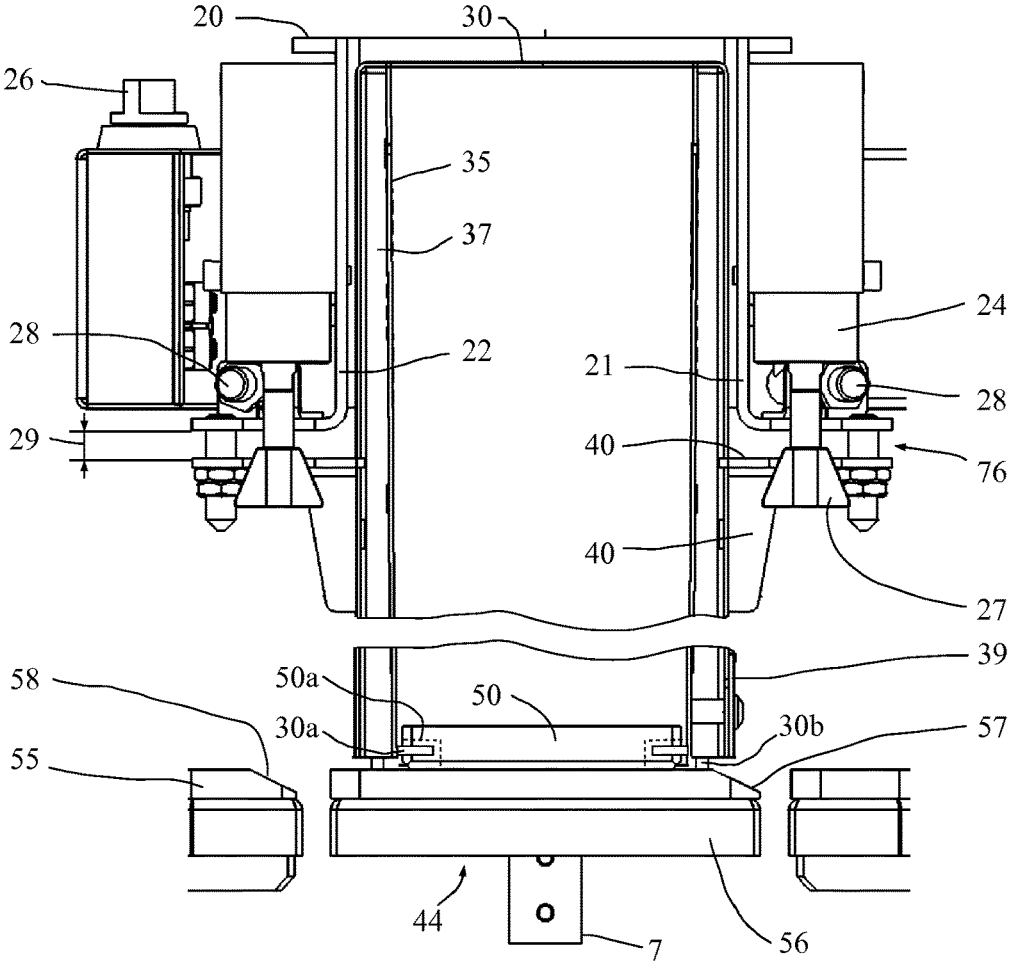

The figures show in:

FIG. 1 a perspective view of an apparatus according to the invention;

FIG. 2 a sectional top view of the apparatus according to FIG. 1;

FIG. 3 an enlarged perspective view of the apparatus according to FIG. 1;

FIG. 4 a still more enlarged perspective detail view of the apparatus according to FIG. 1;

FIG. 5 a horizontal section of the apparatus according to FIG. 1;

FIG. 6 an enlarged cross-section;

FIG. 7 a horizontal view of a detail of the view according to FIG. 1; and FIG. 8 an enlarged illustration of the bag receiving unit in the decoupling position.

With reference to the FIGS. 1 and 2 the basic structure of an apparatus 1 according to the invention that is configured as a filling machine 1 will now be described. FIG. 1 shows a perspective total view of an apparatus 1 for filling bulk goods and fluids into flexible open-top bags 3. The bags 3 processed at the apparatus 1 illustrated in FIG. 1 consist of a flexible material and in particular of plastic material. The apparatus comprises a filling carousel 2, a bag source 70 and an intermediate silo 80 for intermediate storing of the bulk goods.

In this exemplary embodiment the bag source 70 is provided with a film roll 71 on which a sheet of film 72 is wound. The sheet of film 72 unwound from the film roll 71 is fed to a shaping shoulder 73. There the sheet of film 72 consisting of a plastic film is guided around the shoulder and a longitudinal seam is welded so as to create a continuous tubular film.

The bag bottom is manufactured at the handover station 60 by making suitable welding seams transverse to the longitudinal extension of the tubular film. The tubular film having a suitable cross-section is conveyed and taken into the receiving box 62 of the handover station 60. The open-mouth bag 3 intended for filling is form-fittingly received there. For supplying, the tubular film is cut to size so as to manufacture the open top end of the open-mouth bag 3.

It is also possible to manufacture the open-top bags from a prefabricated, e.g. extruded tubular film or else to feed completely prefabricated, flexible bags or sacks from a magazine or the like.

FIG. 1 illustrates the swivel position 63 of the handover station 60 while FIG. 2 illustrates the swivel position 64 at which the open-mouth bag 3 intended for filling is transferred to the handling station 41 acting as the takeover station where the open-mouth bag 3 intended for filling is handed over to the filling station 12 as is illustrated in FIG. 2.

As can be seen in the FIGS. 1 and 2, the apparatus 1 comprises a basic frame to which the filling carousel 2 and the further components are attached. The stationary part 5 of the apparatus 1 comprises a base platform 55. The base platform 55 extends beneath the path of motion of the bag receiving units 30 disposed at the filling stations 11 to 18.

Each of the filling stations 11 to 18 has a retaining device 20 fastened to the movable part 6. Each retaining device 20 in turn carries a bag receiving unit 10 which receives, retains, and guides the bags intended for filling.

This filling carousel 2 is provided for indexed operation so that the filling stations 11 to 18 and the bag receiving units 10 received thereon are successively transported to the individual handling stations 41 to 48.

The takeover station being the handling station 41 takes over an open-mouth bag 3 intended for filling by means of a bag receiving unit 10. FIG. 2 shows the takeover of the open-mouth bag 3 intended for filling by means of the bag receiving unit 10 at the filling station 11. The filling carousel 2 is provided for indexed operation so that following an index the open-mouth bag 3 taken over last is located at the handling station 42 which is provided for high speed flow filling.

As can be seen in FIG. 1, the handling station 42 has a filling turbine 82 and a servo unit 83 and a filling pipe 86 assigned to it. The filling pipe 86 enters into a dust hood 87. During the filling process the dust hood 87 is lowered down into the bag receiving unit 10. A tubular part in the interior of the covering hood 87 extends telescope-like around the filling pipe 86 so that the filling pipe 86 is virtually extended downwardly. This reduces the height of fall of the bulk goods into the open-mouth bag intended for filling so as to reduce the quantity of dust for removal to prevent contamination of the apparatus 1. Moreover this prevents an additional enrichment of the filled product with air due to an unnecessarily large height of fall. Compacting is possible at this filling station e.g. by means of a bottom vibrator already during the filling process.

After indexing the movable part 6 forward the bag intended for filling is conveyed to a compacting station 43 where the material bagged thus far is deaerated and compacted. In the next index the flexible open-mouth bag 3 reaches the handling station 44. This is where another filling turbine 82 driven by a motor 81 is located. The bulk goods intended for filling are fed in low speed flow to the open-mouth bag 3 through a filling pipe 86. Again, a covering hood 87 is provided which enters into the bag receiving unit 10 from above to reduce the height of fall of the bulk goods and thus the dust content and aeration.

Both the handling station 42 and the handling station 44 are provided with servo units 83 in the respective filling pipes 86 allowing pre-adjustment of the open cross-section of the filling pipes 86. In this way for example when filling different materials or identical materials with varying properties, the filling cross-section in high speed flow and the filling cross-section in low speed flow are preadjusted to achieve optimal filling properties.

After filling in low speed flow with the handling station 44 three further handling stations 45, 46 and 47 follow, each providing for compacting the filled material. The filled open-mouth bag is conveyed off at the handling station 48. The handling stations 45, 46 and 47 may be configured as a joint compacting station.

Each bag receiving unit 10 configured as a receiving box 30 is provided with a recognition unit 54 responsive to optical, magnetic or electronic requests and in particular returning a unique signal. In simple cases a bar code may be provided. It is preferred to use RFID (radio-frequency identification) for contactless recognition of the pertaining bag receiving unit 10. This allows to unambiguously identify and assign the bag receiving unit 10 concerned. This is significant for example when changing product or the size of the bags intended for filling to ensure attachment of the matching bag receiving units 10 to the filling carousel 2. This allows to also carry out other format-related machine settings.

Receiving boxes 30 of different heights may be provided for filling different quantities. The handling stations are oriented at the top ends of the receiving boxes 30 so as to dispose their top ends 32 (see FIG. 5) on the same level in the case of different heights of the receiving boxes 30. To carry out longitudinal compensation the height level of the base platform 55 disposed beneath is therefore displaced accordingly.

The filling carousel 2 is supported to rotate around the rotation axis 8 in its entirety. A handover of an open-mouth bag 3 intended for filling (presently) to the filling station 11 takes place at the handling station 41 in the swivel position 64 of the swivel arm 61. The swivel arm 61 with the coupling rod 65 forms a parallelogram-like swiveling device for the receiving box 62 whose basic structure is similar to the receiving boxes 30.

Each of these retaining devices 20 is provided with a pair of holder arms 21 and 22 which are covered on top by a covering hood 25 to protect from dust and contamination.

The height adjusters 85 are provided for height adjustment of the base platform 55 and the separate weigh platform 56. Individual height adjuster components may comprise a drive while other height adjuster components serve for guiding only.

Although the weigh platform 56 is mechanically decoupled from the base platform 55, it is height-adjusted concurrently with the base platform in the same way. A weighing unit 7 not visible in the FIGS. 1 and 2 is assigned to the weigh platform for measuring the weight of the weigh platform 56 and placed thereon, a receiving box 30 including an open-mouth bag 3 placed therein, and the filled bulk goods 4. Deducting the known weights of the receiving box 30, the weight of the bag material 3 and of the weigh platform 56 allows to calculate the weight of the filled bulk goods 4 by way of the gross method.

If any additional bulk goods or the like should accumulate over time on the weigh platform 56 or on individual receiving boxes 30, this may be taken into account by means of an empty run and capturing the tare weights. If the tare weight obtained by checking deviates too much from the original tare weight, a recommendation for servicing or cleaning may be emitted.

FIG. 3 shows an enlarged schematic perspective view of part of the apparatus 1, wherein details of the handover station 60 can be recognized on the left.

The swivel arm 61 and the coupling rod 65 of the handover station 60 are located in the swivel position 64, in which an open-mouth bag 3 intended for filling is handed over from the receiving box 62 to the receiving box 30 located directly underneath. The receiving box 62 and the receiving boxes 30 are provided with suction apertures 34 (see FIG. 4) through which air is sucked off so that an open-mouth bag 3 disposed in the receiving box 62 is placed form-fittingly against the inner wall of the receiving box 62.

After positioning the receiving box 62 in the swivel position 64 illustrated in FIG. 3, the suction at the receiving box 62 is deactivated and suction at the receiving box 30 acting as the receiving unit 10 is activated so that the open-mouth bag 3 is displaced downwardly out of the receiving box 62 into the receiving box 30 where the bag 3 once again comes to lie form-fittingly against the inner wall of the receiving box 30.

In FIG. 3 one can also see the dust hood 87 at the handling station 44. A dust-removing hose, not shown, is connected with the top end of the dust hood 87 to carry off the dusty air.

Each of the receiving boxes 30 comprises a receiving space 31 having a cross section, in this case rectangular, that is approximately constant over the height. Preferably the inner walls extend slightly conically diverging upwardly to facilitate insertion from above and upwardly removal. A preferred angle is between 0.25° and 2° and it may be e.g. 0.35° or 0.5°. The dimensions of the rectangular cross-section depend on the desired dimensions of the filled open-mouth bags. The dimensions are predetermined by the dimensions of the receiving boxes 30 and the flexible bag material is selected accordingly, or vice versa.

Except for the handling station 44 where the weighing unit 7 is provided, the receiving boxes 30 at the other handling stations are each located above the base platform 55.

As can be seen in FIG. 3, the handling stations 45-47 are each or in their entirety provided with at least one compacting drive 84 in the form of e.g. an unbalanced mass vibrator or a magnetic vibrator and at least one spring 79 to obtain efficient compacting of the filled material. Compacting devices acting from above are possible as well.

FIG. 4 shows a further enlargement of a perspective view of the filling carousel 2, presently with one receiving box 30 only at a retaining device 20. The suction apertures 34 can be seen in the interior of the receiving box 30. The receiving box 30 is provided with retaining link plates 40 with which the receiving box 30 is fastened to the holder arms 21 and 22 of the retaining device 20. The bottom end 33 of the receiving box 30 shows a service door 39 to provide access to the intermediate space of the double-walled receiving box 30. When multiple intermediate spaces disposed on top of one another and separated from one another are provided, a corresponding number of service doors 39 is preferably provided.

A receiving box 30 may be decoupled by means of a control device not shown in detail. Manual decoupling is possible any time by way of the unlatching device 26.

In FIG. 4 one can also recognize the suction duct 23 at the retaining device 20 through which the air is sucked out through the suction apertures 34 at the receiving box 30. Above the service door 39 shown in a solid line another service door 39 is illustrated in a broken line in the case of two intermediate spaces disposed on top of one another.

FIG. 5 shows a part sectional side view of the apparatus 1, where one can see the rotation axis 8 of the filling carousel 2 and the drive 19 of the filling carousel 2.

At the bottom end of the receiving boxes 30, bottom plates 50 lie on the base platform 55 so that a bag 3 received in the receiving box 30 is supported on the top surface of the bottom plate 50. The bottom surface of the bottom plate 50 is in gliding contact with the base platform 55 when the filling carousel 2 is indexed further.

Thus, the bottom plate 50 represents a gliding plate or wear plate that protects the bottom of an open-mouth bag 3 intended for filling from being contaminated or damaged while the filling carousel 2 rotates or advances.

The receiving box 30 is shown in FIG. 5 in cross-section. It can be seen that an air chamber 37 extends from the top end 32 to the bottom end 33 between the inner wall 35 and the outer wall 36. A plurality of suction apertures 34 is disposed on the inner wall 35 for the bag wall to lie form-fittingly against the receiving space 31 of the receiving box 30.

The intermediate space 37 is supplied with a vacuum through the suction branch 38. The shown suction branch 38 ends slightly spaced apart from the suction duct 23 attached to the movable part 6. The suction duct 23 couples to the suction connection 52 at the specified fixed angular positions. A sealing connection is provided by means of the gliding sleeve 53 which glides over the outer surface of the presently annular deaeration duct 9 while the movable part 6 rotates.

The bottom plate 50 is also provided with suction apertures 34 through which air is sucked off preferably at the takeover station 41 to suck an open-mouth bag 3 intended for filling into the receiving box 30 from above or to support the movement. It is also possible to provide, instead of suction apertures 34 in the bottom plate, additional, controlled suction apertures in a bottom region of the receiving box 30.

The FIGS. 5 and 6 show in broken lines a variant where a number of regions 31*a*, 31*b* and 31*c* across the height are provided for coupled or else separately controlled suction. A lower region 31*a* is provided with additional suction apertures 34 which are shown having a rectangular cross-section. Or else these suction apertures 34 may be round, oval or slotlike or shaped otherwise. This configuration allows to omit suction apertures 34 in the bottom plates in part and in particular entirely.

For handing over an open-mouth bag 3 intended for filling to the bag receiving unit 10 or the receiving box 30, air may firstly be sucked off e.g. only in the upper region 31*c* through the suction apertures 34 in the upper region 31*c* along the drawn arrow. When the bag 3 has already been sucked some distance into the receiving box 30, suction may be activated or boosted in the mid region 31*b* while in the upper region 31*c* suction is reduced and optionally temporarily entirely deactivated. Finally, suction takes place in the lower region 34 so that a bag 3 is placed all the way down.

It is also possible and preferred to then emit an air blast from above downwardly into the opened bag 3 which takes the bag 3 that is held open reliably and reproducibly down and positions it on the bottom plate 50 or on the base platform 55 in case no bottom plate 50 is provided. The strength of the air blast emitted through one or more air nozzles may be determined by experimenting. In the alternative or supplementary to an air blast, a mechanical pressing device may force the bag bottom downwardly. At the same time, the suctioning action through the suction apertures 34 may be slightly reduced to ensure reliable lowering of the opened bag 3 in the bag receiving unit 10.

FIG. 6 shows a cross-section of the receiving box 30 transverse to the cross-section in FIG. 5. The receiving box 30 is retained at the retaining device 20 by means of the lateral retaining link plates 40. The manual unlatching device 26 is provided on the side. In the lower region 31*a* the bottom plate 50 rests on the base platform 55 also provided with suction apertures 34 which are coupled with the suction connection 51 beneath the bottom platform 55. The suction connection is connected with a suction hose, presently not shown.

It can be seen that a plurality of suction apertures 34 each is arranged in the lower region 31*a*, in the mid region 31*b*, and in the upper region 31*c*. The suction apertures in the different regions 31*a* to 31*c* may preferably be controlled separately if the separating webs 35*a* and 35*b* shown in broken lines are provided which then subdivide the intermediate space 31 in separate air chambers 37*a*, 37*b* and 37*c*. Controlling may be provided by separately controlled valves.

Or else it is possible to provide a specific suctioning profile across the height of the receiving box 30 by way of the number and types of suction apertures or by way of their cross-sections or by way of fixed flow cross-sections and flow paths.

FIG. 6 furthermore shows a configuration of the suction apertures 34 at the bottom plate 50 which is conceivable in all the configurations. The bottom surface of the bottom plate is formed primarily or even predominantly by an air-permeable support unit 50*b* which in this case comprises a wire cloth or multiple wire cloths. Due to the suction aperture 34 being covered by the wire cloth 50*b* the bag intended for filling can rest with its entire bottom on the bottom surface. Any bagging or deforming of the bottom due to the filled weight and/or due to suction can be largely or entirely avoided. It is also possible to use wire netting or other components to support the bottom surface. In all the cases at least one separate support member may be provided beneath the wire cloth for supporting said wire cloth as it is schematically shown in FIG. 6.

FIG. 7 shows a side view of part of the apparatus 1 with the handling station 44 visible. The handling station 44 is provided with the weighing unit 7 which can weigh the separately configured weigh platform 56 and the parts located thereon. FIG. 7 shows a state as it is present just as the handling station 44 has been reached. At this moment the receiving box 30 is still firmly coupled to the retaining device 20 through the locking unit 24 so that the receiving box 30 is not shown resting on the weigh platform 56 but located a short distance above.

Resting on the weigh platform 56 is the bottom plate 50 which is free to move in the vertical direction relative to the receiving box 30 while being configured high enough so that the receiving box 30 pulls the bottom plate 50 along in the rotational motion of the filling carousel 2. Thus, there is gliding relative motion between the bottom surface of the bottom plate 50 and the weigh platform 56 respectively the base platform 55 as the movable part 6 is indexed further. To ensure better transfer of the bottom plate 50 from the base platform 55 to the weigh platform 56 or in the next index from the weigh platform 56 to the base platform 55, the weigh platform 56 is provided with a momentum grade 57 and the base platform 55 is provided with a momentum grade 58.

A broken line in FIG. 7 shows an open-mouth bag 3 which for better clarity is shown spaced apart from the inner wall 35. The open-mouth bag 3 virtually comes to rest firmly against the inner wall 35. Some bulk goods 4 are exemplarily shown in the open-mouth bag 3.

The base platform 55 is height-adjustable and it may be adjusted high or still higher, for example up to the broken line 89, for mounting suitable receiving boxes 30 to the handling stations 41 to 48. After an exchange, bags having correspondingly smaller volumes may be filled.

FIG. 8 shows an enlarged detail view of a receiving box 30 at the weighing station 44 with the receiving box 30 shown in the lowered decoupling position 76. For decoupling, the clamping cone 27 of the locking unit 24 is extended so that the receiving box 30 previously lifted up by the retaining link plates 40 is lowered and rests on the weigh platform 56 at the weighing station 44. Extending the lifting unit respectively locking unit 24 achieves a decoupling of the weight of the receiving box 30 from the pertaining filling station respectively the pertaining retaining device 20. This allows to very accurately determine the weight thus far filled into the bag 3.

To facilitate lowering the receiving box relative to the filled bag, the connection of the suction duct 23 with the suction branch 38 may be interrupted at the weighing station to enable relative motion between the bag and the receiving box. Even if the receiving box is not lowered completely, the receiving box together with the bag rests on the weigh platform 56 by way of friction fit, which results in precise weighing by the gross method as it has been described.

For example if bulk goods intended for filling should accumulate in the intermediate space 37, the service door 39 may be opened as required to empty out and optionally clean the intermediate space 37.

FIG. 8 shows in a broken line a pair of recesses or grooves 50*a* at the bottom plate 50 which serve to receive holding units or lugs 30*a* at the receiving box 30. The components 50*a* and 30*a* ensure that the bottom plate 50 does not fall out when the receiving box 30 is lifted manually. In simple cases the holding units or lugs 30*a* at the receiving box 30 are manufactured by folding over the metal sheet edge of the receiving box 30.

The receiving box 30 may be supported on three feet 30*b* in all the configurations. At least one of the feet 30*b* may be adjustable. Preferably all of the feet 30*b* are adjustable. This prevents the receiving box 30 from resting on its outer frame as the receiving box 30 is lowered at the weigh platform 56. In the case of any manufacturing tolerances the receiving box 30 may be prevented from slightly inclining in any direction. Thus the receiving box 30 can be prevented from leaning against the holding brackets which would adulterate the weight. One, two or three adjustable feet 30*b* ensure that the receiving box 30 sits in a defined position but not on the circumferential rectangular frame. This allows optimal adjustment of every receiving box 30.

It is also possible to omit the feet 30*b* so that the receiving box 30 rests on its circumferential rectangular frame, if sufficiently narrow tolerances are ensured.

On the whole the invention provides an advantageous apparatus and an advantageous method which allow simple, efficient handover to a filling station of open-mouth bags intended for filling and which are still empty. The bottom of the open-mouth bag 3 is conveyed into the receiving box 30 due to gravitation and supported by suctioning. Due to the suction through the suction apertures 34 the bag wall comes to rest form-fittingly against the receiving box 30 so that the open-mouth bag 3 assumes an ideal, desired shape even prior to filling. This achieves efficient and material-saving filling. Moreover an optically appealing shape of the filled open-mouth bag 3 is ensured. Moreover the dust hood 87 is enabled to safely enter into the receiving box 30 and in particular even into the opened bag 3.

The receiving boxes 30 guide the open-mouth bags 3 intended for filling during transport by means of the movable part 6. To enhance weighing the receiving box 30 at the weighing station is taken to a decoupling position to determine the weight remaining to be filled and in particular to control filling the remainder into the open-mouth bag in low speed flow. A number of stations are provided where the filled material is compacted. Vibrating is possible both from beneath and from above, or else a vacuum lance or a vibrating lance or the like may enter into the opened open-mouth bag 3 to carry out efficient deaeration and thus compacting.

List of reference numerals:

| | |
|---|---|
| 1 | filling machine |
| 2 | filling carousel |
| 3 | open-mouth bag |
| 4 | bulk material |
| 5 | stationary part |
| 6 | movable part |
| 7 | weighing unit |
| 8 | rotation axis |
| 9 | deaeration duct |
| 10 | bag receiving unit |
| 11-18 | filling station |
| 19 | drive |
| 20 | retaining device |
| 21-22 | holder arm |
| 23 | suction duct |
| 24 | locking unit |
| 25 | covering hood |
| 26 | unlatching device |
| 27 | clamping cone |
| 28 | detector |
| 29 | lift |
| 30 | receiving box |
| 30a | lug |
| 30b | foot |
| 31 | receiving space |
| 31a | lower region |
| 31b | mid region |
| 31c | upper region |
| 32 | top end |
| 33 | bottom end |
| 34 | suction aperture |
| 35 | inner wall |
| 35a | separating web |
| 35b | separating web |
| 36 | outer wall |
| 37 | air chamber |
| 37a | air chamber |
| 37b | air chamber |
| 37c | air chamber |
| 38 | suction branch |
| 39 | service door |
| 40 | retaining link plate |
| 41-48 | handling station |
| 50 | bottom plate |
| 50a | groove |
| 50b | wire cloth |
| 51-52 | suction connection |
| 53 | gliding sleeve |
| 54 | recognition unit |

-continued

| List of reference numerals: | |
|---|---|
| 55 | base platform |
| 56 | weigh platform |
| 57 | momentum grade |
| 58 | momentum grade |
| 60 | handover station |
| 61 | swivel arm |
| 62 | receiving box |
| 63 | swivel position |
| 64 | swivel position |
| 65 | coupling rod |
| 66 | drive |
| 70 | bag source |
| 71 | film roll |
| 72 | sheet of film |
| 73 | shaping shoulder |
| 75 | locking position |
| 76 | decoupling position |
| 79 | spring |
| 80 | intermediate silo |
| 81 | motor for turbine |
| 82 | turbine |
| 83 | servo unit |
| 84 | compacting drive |
| 85 | height adjustment |
| 86 | filling pipe |
| 87 | dust hood |
| 88 | hose coupling |
| 89 | higher position |

The invention claimed is:

1. Apparatus for filling flowable materials into flexible, empty open-mouth bags comprising a stationary part and a movable part wherein the movable part is provided with multiple filling stations traveling along and a retaining device is fastened to the movable part at each of the filling stations, and wherein multiple handling stations are provided that are distributed at the stationary part, wherein at least one handling station is configured as a takeover station for taking over empty open-mouth bags and at least one handling station is provided for at least partially filling a bag, and wherein at least one handling station is provided with a weighing unit, characterized in that a bag receiving unit is fastened to each of the retaining devices to receive a bag, the bag receiving unit being configured to receive and guide the bag, and that the bag receiving unit at the handling station equipped with the weighing unit can be temporarily decoupled from force transmission with respect to the retaining device so as to enable separate weighing of the bag receiving unit with the bag.

2. The apparatus according to claim 1, wherein the bag receiving unit is tubular in configuration and comprises at least one open top end.

3. The apparatus according to claim 1, wherein a base platform is disposed at the stationary part beneath the bag receiving unit.

4. The apparatus according to claim 3, wherein the bag receiving unit is exchangeable and the base platform is height-adjustable.

5. The apparatus according to claim 3, wherein the bag receiving unit is configured with an open bottom such that the base platform can support at least part of the open-mouth bag.

6. The apparatus according to claim 3, wherein a bottom plate can be inserted into an open bottom of the bag receiving unit which is supported on the base platform at least at a handover station and which bottom plate is subjected to a relative motion to the base platform in movement of the movable part.

7. The apparatus according to claim 6, wherein the bottom plate is configured as a gliding plate.

8. The apparatus according to claim 1, wherein a locking unit is provided with which the bag receiving unit can be transferred from a locking position coupled with the retaining device to a decoupling position.

9. The apparatus according to claim 8, wherein the locking unit comprises a height-adjustable clamping cone that is provided to interact with a retaining link plate at the bag receiving unit.

10. The apparatus according to claim 8, wherein the bag receiving unit is lifted in the locking position and wherein the bag receiving unit can be lowered to a no-force decoupling position on a weigh platform.

11. The apparatus according to claim 10, wherein the weigh platform is mechanically separated from a base platform which is disposed at the stationary part beneath the bag receiving unit.

12. The apparatus according to claim 1, wherein each bag receiving unit comprises a recognition unit having a unique ID sign.

13. The apparatus according to claim 1, wherein a filling pipe is assigned to the handling station equipped with the weighing unit.

14. The apparatus according to claim 1, wherein at least one of the handling stations is configured as a compacting station.

15. The apparatus according to claim 1, wherein the bag receiving unit includes a plurality of suction apertures so that a wall of the bag can be made to lie snug against a receiving space.

16. The apparatus according to claim 1, wherein the movement of the movable part is indexed.

17. Method for filling flowable materials into flexible, empty open-mouth bags comprising an apparatus with a stationary part and a movable part wherein the movable part is provided with multiple filling stations traveling along and a retaining device is fastened to the movable part at each of the filling stations, and wherein multiple handling stations are provided that are distributed at the stationary part, wherein at least one handling station acting as a takeover station successively takes over empty open-mouth bags and at least one handling station at least partially fills the bags, and wherein at least one handling station is provided with a weighing unit, characterized in that a bag receiving unit is fastened to each of the retaining devices to receive a bag, wherein the bag receiving unit receives and guides the bag at the takeover station, and that the movable part successively takes the bag receiving units to the handling stations, and that the retaining device provided at the handling station equipped with the weighing unit temporarily decouples the bag receiving unit being handled from force transmission with respect to the retaining device so that a separate weighing of the bag receiving unit with the bag can be carried out.

18. The method according to claim 17, wherein material is filled into the open-mouth bag at the handling station equipped with the weighing unit.

19. The apparatus according to claim 1, wherein the flowable materials are fluid or bulk goods.

20. The method according to claim 17, wherein the flowable materials are fluid or bulk goods.

* * * * *